US006008184A

United States Patent [19]

Pluyter et al.

[11] Patent Number: 6,008,184

[45] Date of Patent: Dec. 28, 1999

[54] BLOCK COPOLYMERS FOR IMPROVED VISCOSITY STABILITY IN CONCENTRATED FABRIC SOFTENERS

[75] Inventors: Johan Gerwin Lodewijk Pluyter, Eureka, Calif.; Myriam Gerarda Eeckhout, Gent, Belgium

[73] Assignee: The Procter & Gamble Company, Cincinnati, Ohio

[21] Appl. No.: 08/809,683

[22] PCT Filed: Sep. 1, 1995

[86] PCT No.: PCT/US95/11172

§ 371 Date: Apr. 28, 1998

§ 102(e) Date: Apr. 28, 1998

[87] PCT Pub. No.: WO96/10671

PCT Pub. Date: Apr. 11, 1996

[30] Foreign Application Priority Data

Sep. 30, 1994 [EP] European Pat. Off. ..... 94870155

[51] Int. Cl.[6] ..... D06M 15/00; D06M 15/19

[52] U.S. Cl. ..... 510/524; 510/461; 510/475; 510/515; 510/522

[58] Field of Search ..... 510/515, 461, 510/475, 522, 524

[56] References Cited

U.S. PATENT DOCUMENTS

| | | | |
|---|---|---|---|
| 4,429,859 | 2/1984 | Steiner et al. | 510/524 |
| 4,702,857 | 10/1987 | Gosselink | 510/299 |
| 4,767,547 | 8/1988 | Straathof et al. | 510/517 |
| 5,281,355 | 1/1994 | Tsaur et al. | 510/393 |
| 5,510,042 | 4/1996 | Hartman et al. | 510/516 |
| 5,767,062 | 6/1998 | Trinh et al. | 510/516 |

FOREIGN PATENT DOCUMENTS

| | | | |
|---|---|---|---|
| 185 427 | 6/1986 | European Pat. Off. . | |
| 0 239 910 A2 | 10/1987 | European Pat. Off. | C11D 1/62 |
| 458599 | 11/1991 | European Pat. Off. . | |

*Primary Examiner*—Anthony Green
*Attorney, Agent, or Firm*—Robert B. Aylor

[57] ABSTRACT

Liquid fabric softener compositions containing a combination of certain block copolymers and water soluble polymers to provide excellent storage stability and viscosity characteristics, especially at elevated temperatures.

8 Claims, No Drawings

BLOCK COPOLYMERS FOR IMPROVED VISCOSITY STABILITY IN CONCENTRATED FABRIC SOFTENERS

TECHNICAL FIELD

The present invention relates to fabric softener compositions to be used during the rinse cycle of a textile laundering operation to provide fabric softening/static control benefits.

The fabric softening compositions comprise beyond the conventional softener ingredients one or more polymers having a hydrophobic backbone with one or more hydrophilic side chains and are characterized by excellent storage stability and viscosity characteristics.

BACKGROUND OF THE INVENTION

Fabric softener compositions, especially concentrated and/or superconcentrated, are dispersions of positively charged vesicles containing the softener active. These vesicles are believed to be comprised of alternating concentric layers of water and lamellar cationic bilayers, so-called lamellar droplets. The presence of lamellar droplets in a fabric-softening composition can be detected by methods known to persons skilled in the art like optical techniques, rheometrical measurements, X-ray diffraction and electron microscopy. The droplets consist of an onion-like configuration of, as pointed out above, concentric bilayers of molecules of fabric-softening material with entrapped water or electrolyte solution, the so-called aqueous phase.

A well-appreciated fabric softener product exists of physical stability and desirable flow properties combined in one system.

However, upon storage the dispersions above-mentioned are thickening and eventually gelling. The reason for this phenomenon is not yet clear. There are, at least, two theoretical possibilities: the lamellar vesicles are increasingly interconnecting with time and eventually (1) form an infinitely inter-connected vesicle network or gel, or (2) change from a lamellar vesicle to a two-phase lamellar phase in which gelation may occur.

Regardless of the mechanism, gelation probably will be avoided as long as the vesicles are kept separated from each other.

It is well-known that two factors mainly determine the viscosity and stability of the fabric softening composition. First of all, it is the volume (fraction) of the dispersed lamellar phase in the composition and secondly it depends on the state of aggregation of these droplets. In general, the higher the volume (fraction) of the droplets (dispersed lamellar phase), the higher the viscosity which, if too high, results in an unpourable product. One way to solve this problem is using electrolytes whereby apparently the size of the lamellar vesicles is reduced and, as such, increases the inter-vesicle distances preventing aggregation/gelation.

However, the stability of other components in the fabric-softener composition is affected using higher electrolyte levels.

So there are limits to the amount of fabric softening material and electrolyte to be used whilst still having an acceptable product. There is a continued need for more concentrated, sometimes superconcentrated, fabric softening compositions for convenience and cost reduction purposes. The problem to be solved is that these high concentrations of softener active in the compositions must have an acceptable stability and at the same time pourability upon use.

SUMMARY OF THE INVENTION

We have now found that, with respect to the stability and viscosity requirements especially at elevated temperature, a fabric softening composition having conventional softener ingredients can be surprisingly favourable influenced by incorporating a block copolymer comprising a hydrophobic backbone with one or more hydrophilic side chains in the presence of a non-ionic water soluble polymer. These polymeric materials reduce the viscosity of concentrated dispersions of cationic softener actives in lamellar vesicles and improves unexpected the stabilizing properties of the fabric softening compositions. As such, they prevent these types of formulations from gelling or solidifying. Another practical benefit of these materials is that they prevent skin formation and dispenser residue upon use.

Furthermore, we have found that the use of a block copolymer with a hydrophobic backbone and one or more hydrophilic side chains according to the invention in a fabric softener composition, reduces the viscosity of the composition at low and high temperature as well.

DETAILED DESCRIPTION OF THE INVENTION

The objective of polymer stabilization in concentrated fabric softener formulations is to maintain low viscosity upon storage at low (0° C.) and high (50° C.) temperatures without affecting the softening performance. It appears that so-called di- and tri-block copolymers of the types A-B and A-B-A, respectively, and preferably tri-block copolymers with highly water-soluble blocks (A) and an insoluble or partially water-soluble blocks (B) in combination with a very water-soluble polymer (cloud point larger than 90° C.) provides excellent viscosity stabilization of concentrated compositions. The block copolymers are defined as: (a) separated polymer blocks (of more than two units) of the same kind separated by, at least, one monomer of another kind, (b) different kinds of polymer blocks of more than two monomers that are chemically connected. Probably a mixed depletion/steric stabilization phenomenon is likely to be responsible for this behavior. Key parameters in the structure of these materials are (1) the chain lengths of the blocks, (2) the water-solubility of the blocks, and (3) the specific interactions of the B blocks with the lamellar vesicles. In addition, we have also found that said di- or tri-block copolymers without the water-soluble polymer provide excellent viscosity stabilization especially at high elevated temperature.

The following five general polymer structures (I–V) provide above-mentioned viscosity stabilization:

(I) polymers that are likely to adhere physically to the positively charged vesicle surface: C-(A)x-(B)y-D and C-(A)x-(B)y-(A)z-D, where the monomers A and B are water soluble and partially water insoluble respectively, and C and D are end groups or a hydrogen atom. Typical end groups are hydroxyl, acetate, methyl amine or quaternary amine.

(II) Polymers that are likely to be incorporated into the lamellar vesicles: D-(A)x-R-(A)z-C, where R is a polymer of B monomers as defined above, or preferably a fatty alcohol or acid of which one carbon atom is substituted with polymer blocks. For instance, the mono fatty ester of ethoxylated glycerol.

(III)Combinations of polymers of type (I) and (II) with nonionic water soluble polymers, such as polyvinyl pyrrolidone, polyvinyl pyridine-N-oxide, polyethylene glycol, and substituted poly alcohol.

Further details about these polymer structures are described below.

(IV) Polymer combinations amongst type (I), amongst type (II) and mixed type (I)+type (II) combinations.

(V) Combinations of (III) and (IV).

In EP 458 599, an attempt is made to solve the problem of stability and acceptable viscosity of the finished product. A fabric treatment composition is disclosed therein comprising an aqueous base, one or more, fabric-softening materials and an emulsion component. The composition has a structure of lamellar droplets of the fabric-softening material in combination with an emulsion, said composition also comprises a deflocculating polymer of a hydrophilic backbone and one or more hydrophobic sidechains.

However, it appears that using these types of polymers (block copolymers), the pressumed right system for ideal steric stabilization is not created. This steric stabilization mechanism requires that the polymer chains, which are soluble in the continuous phase, are physically or chemically grafted onto the particle surface. The remaining part of the polymer (the stabilizing polymer chain) is, ideally, pointing away from the particle surface. In a sterically stabilized dispersion of particles, these stabilizing polymer chains are rejecting each others presence in the continuous phase. The following mechanism is generally accepted for steric stabilization. When the polymer-water (continuous phase) and water-water molecular interactions are much higher than the polymer-polymer interactions (water solubility requirements) there occurs some kind of microphase separation. Of course, there are not two separate phases present, but at the molecular level the polymer molecules remain separated. If, on the other hand, polymer-polymer interactions are larger than polymer-water interactions, the polymer chains of different particles will attract each other, and will cause destabilization of the dispersion. The phenomenon appears as a repulsive interaction between the polymer chains (steric stabilization).

Key parameters for this type of stabilization are:

(a) the stabilizing polymer chains must be very soluble in the continuous phase, while the attached part of the polymer must be insoluble;

(b) the stabilizing polymer chain must be of a minimum (and optimum) length in order to stabilize the dispersion efficiently.

Both conditions are not met by applying the polymers as described in EP 458, 599.

We have found that block copolymers with cloud points ranging from 40° C. and higher are able to stabilize aqueous dispersions of lamellar vesicles. The cloud point dependence is caused by the chain length of the water-soluble and insoluble blocks, as well as the ratio of the two chain lengths. The insoluble blocks may be as hydrophobic as poly propylene oxide (PO) ranging, from aliphatic/aromatic polyesters to aliphatic chains. When the chain lengths are too short, e.g. (A)x blocks with x<20 and (B)y blocks with y=3, the opposite of viscosity stabilization occurs; extreme thickening or even gelation takes place.

The level of these types of polymers ranges from 0.1–10%, preferably 0.1–5%, and even more preferable 0.5–2%.

In EP 0 185 427 (Gosselink) these polymers are described in the context of soil release polymer in fabric softening composition. We have found a new use of these polymers viz. the reduction of viscosity of the composition at low and elevated temperature. Surprisingly the compositions remain stable with respect to the viscosity as well.

In addition, these polymers prevent skin formation. This occurs through specific complexation of water molecules with the water-soluble polymer blocks. This complexation with water reduces the vapour pressure of water, which slows down or even prevents skin formation. Examples of such cases are block copolymers with poly ethoxylate, polyvinyl pyrrolidone, and polyvinyl pyridine-N-oxide (ethoxylated and/or partially cationic) blocks. The best molecular weight range of the water-soluble blocks for minimum skin formation ranges from 100–20000, preferably from 2000–8000.

The polymers may be added at any point in the process. However, this is dependent on the formulation matrix. Three points of addition are preferred: (1) to the water seat, (2) on top of the formulation before or after the perfume addition (hot or cold), (3) a combination of (1) and (2). Preferred is the point of addition (1) which, probably assists the incorporation of the polymer in the vesicle structure. The best ways of addition are via the water seat or afterwards while hot (40–90° C.) or ambient.

Type I Polymers

The polymers of type I likely to adhere to the positively charged vesicle surface have the general formula (1) C-(A)x-(B)y-D and formula (2) C-(A)x-(B)y-(A)z-D respectively viz. so-called di- and triblock copolymers.

The monomers A and B are water soluble and partially water insoluble groups, respectively. The degrees of polymerization x and z are preferably of the same order of magnitude. The structural parameters x and z are from 1–200, preferably 30–60; y ranges from 1–70, preferably from 3–40. C and D are end groups and may be selected form the same series of groups. However, some situations require them to be different.

Possible Types of Monomers for A (Water-soluble as Polymers):

Ethylene oxide

Vinylpyrrolidone

Vinyl 2- and 4-pyridine

Vinyl 2- and 4-pyridine-N-oxide

Cationic 2- and 4-vinyl pyridine

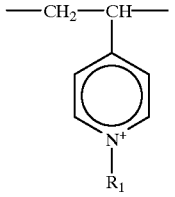

R1=alkoxylate—(CrH2rO)q—, where r=1–6, pref. 1–3; and q=1–80, pref. 2–60. This includes ethoxylated 2- and 4-vinyl pyridine. The counter ion may be halide ions, methyl sulphate, acetates, sulphates.

Vinyl alcohol

Acrylamides

Cationic acrylamides,

—CHR—(CH2)n—O— where R=—(CH2)m—CH3,—OH, pyrrolidone, 2- and 4-pyridine-N-oxide, cationic 2- and 4-pyridine, ethoxylated 2- and 4-pyridine.

Saccharides

Aminoacids

—(CH2)n—Z(AA)— where AA is any amino acid that is bound via the carboxylic acid group. The amino acid may be made cationic or amine oxidized when a nitrogen in a ring structure is used (e.g. tryptophan and histidine). Z may be a =CH, =CH—COO, or =CH—O— group. n=1–10, preferably 1–4.

Possible Types of Monomers B for the Following Polymers (Partially Water-soluble to Insoluble as Polymers):

Poly(alkylene terephthalate) where the alkylene group may be

C1–C10, preferably C2–C4.

Aliphatic polyesters, —O—(CH2)n—CO—, where n=1–10, preferably 1–4.

Polybutadiene

Hydroxylated polybutadiene

Straight saturated and unsaturated aliphatic chains, carbon chain length C4–50, preferably C4–20.

Poly (3-hydroxybutyric acid), degrees of polymerization of 4–50, preferably 4–30.

Aliphatic/aromatic or mixed carbonates

Esterified polysaccharides

Polysiloxanes

Polyurethanes

Polyacrylates

Cellulose derivatives, such as chitosans.

Possible end Groups C and D:

Hydrogen atoms

Hydroxyl groups

Alkoxy groups, —O—R—, where R=H, saturated or partially unsaturated aliphatic alkanes Methyl groups Alkyl groups

—CH(CH3)2, —CH2(CH3), —C(CH3)3

Alkyl chains straight chain saturated and unsaturated fatty alcohol/acid, chain length C4–50, preferably C4–20.

Cationic end groups, such as —CH2—CO—$N^+$(CH3)3 X—, where X is a halide ion, methyl, sulphate or acetate.

—O—CO—(CH2)n—CH3, where n=2–30, preferably 2–20.

Sulphonate groups.

Type II Polymers

These polymers are likely to be partially incorporated into the posivitely charged vesicle and have the following general structure of formula (3):

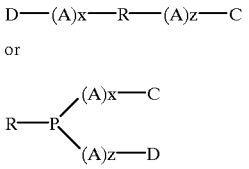

A,x,z,C, and D are defined as in type I polymers.

P is a glycerol or other polyalcohol unit such as poly (vinyl)alcohol or polysaccharides or the one shown below.

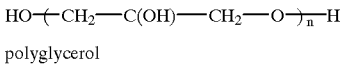

polyglycerol

Other types of polymers that are likely to be partially incorporated in the lamellar vesicles when stabilizing dispersions are shown below (a substituted polyglycerol).

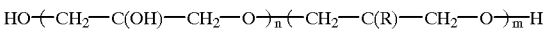

In these polymer types, R can be a polymer of the monomers of type B, but is preferred to be a saturated or unsaturated fatty acid, n=1–10, preferably 1–8, and m=1–10, preferably 1–5. The hydroxyl end groups may be replaced by the end groups C and D, as defined in the previous polymer types.

Improved viscosity stabilization at low and elevated temperature as well occurs by using mixtures of completely water-soluble polymers and di- or tri-block copolymers according to the invention.

The viscosity stabilizing properties of di-and tri-block copolymers of the types I and II, or polymers mentioned in EP 0 185 427 (E. P. Gosselink), or mixtures thereof, can be improved by addition of small amounts of completely water-soluble polymers (cloud point larger than 90° C.), such as poly vinyl pyrrolidone, polyvinyl pyridine-N-oxide, polyethylene glycol, substituted poly glycerols. The weight % of di- or tri-block copolymers in the formulation ranges from 0.1–10%, preferably from 0.2–6%. The weight % of completely water-soluble non-ionic polymers in the formulation ranges from 0.1–10%, preferably from 0.2–6%.

Fabric conditioning compositions, in particular fabric softening compositions to be used in the rinse cycle of laundry washing processes, are well known.

The fabric softening materials may be selected from cationic, nonionic, amphoteric or anionic fabric softening material.

Compositions of the present invention preferably comprise from 1 to 80% by weight of fabric softening active, more preferably from 2 to 70% by weight, most preferably from 5 to 50% by weight of the composition.

Typically, such compositions contain a water-insoluble quaternary-ammonium fabric softening active, the most commonly used having been di-long alkyl chain ammonium chloride.

In recent years, the need has arisen for more environmentally-friendly materials, and rapidly biodegradable quaternary ammonium compounds have been presented as alternatives to the traditionaly used di-long chain ammonium chlorides. Such quaternary ammonium compounds contain long chain alk(en)yl groups interrupted by functional groups such as carboxy groups.

Said materials and fabric softening compositions containing them are disclosed in numerous publications such as EPA 040 562, and EPA 239 910.

In EPA 239 910, it has been disclosed that a pH range of from 2.5 to 4.2 provides optimum storage stability to said rapidly biodegradable ammonium compounds.

The quaternary ammonium compounds and amine precursors herein have the formula (I) or (II), below:

(I)

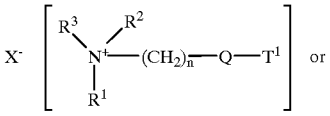

or (II)

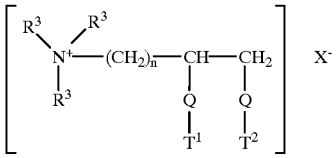

Q is

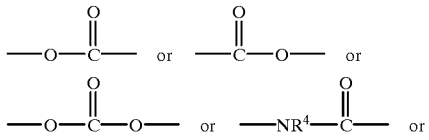

-continued

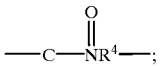

$R^1$ is $(CH_2)_n$—Q—$T^2$ or $T^3$;
$R^2$ is $(CH_2)_m$—Q—$T^4$ or $T^5$ or $R^3$;
$R^3$ is $C_1$–$C_4$ alkyl or $C_1$–$C_4$ hydroxyalkyl or H;
$R^4$ is H or $C_1$–$C_4$ alkyl or $C_1$–$C_4$ hydroxyalkyl;
$T_1$, $T^2$, $T^3$, $T^4$, $T^5$ are (the same or different) $C_{11}$–$C_{22}$ alkyl or alkenyl;
n and m are integers from 1 to 4; and
$X^-$ is a softener-compatible anion.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowoyl-oxy-ethyl)-N,N-dimethyl ammonium chloride;
2) N,N-di(tallowoyl-oxy-ethyl)-N-methyl, N-(2-hydroxyethyl);
3) N,N-di(2-tallowyloxy-2-oxo-ethyl)-N,N-dimethyl ammonium chloride;
4) N,N-di(2-tallowyloxyethylcarbonyloxyethyl)-N,N-dimethyl ammonium chloride;
5) N-(2-tallowoyloxy-2-ethyl)-N-(2-tallowyloxy-2-oxo-ethyl)-N,N-dimethyl ammonium chloride;
6) N,N,N-tri(tallowyl-oxy-ethyl)-N-methyl ammonium chloride;
7) N-(2-tallowyloxy-2-oxoethyl)-N-(tallowyl-N,N-dimethyl-ammonium chloride; and
8) 1,2-ditallowyl oxy-3-trimethylammoniopropane chloride.; and mixtures of any of the above materials.

Of these, compounds 1–7 are examples of compounds of Formula (I); compound 8 is a compound of Formula (II).

Particularly preferred is N,N-di(tallowoyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentrability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g.:

replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the claimed pH values.

The quaternary ammonium or amine precursors compounds herein are present at levels of from about 1% to about 80% of compositions herein, depending on the composition execution which can be dilute with a preferred level of active from about 5% to about 15%, or concentrated, with a preferred level of active from about 15% to about 50%, most preferably about 15% to about 35%.

Optional Ingredients

Fully formulated fabric softening compositions preferably contain, in addition to the compounds of Formula I or II herein, one or more of the following ingredients:

Firstly, the presence of polymer having a partial or net cationic charge, can be useful to further increase the cellulase stability in the compositions herein. Such polymers can be used at levels of from 0.001% to 10%, preferably 0.01% to 2% by weight of the compositions.

Such polymers having a partial cationic charge can be polyamine N-oxide containing polymers which contain units having the following structure formula (A):

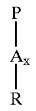

(A)

wherein P is a polymerisable unit, whereto the R—N→O group can be attached to or wherein the R—N→O group forms part of the polymerisable unit or a combination of both.

A is

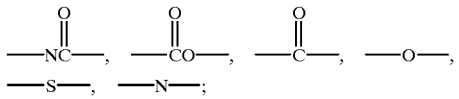

x is 0 or 1;

R are aliphatic, ethoxylated aliphatics, aromatic, heterocyclic or alicyclic groups or any combination thereof whereto the nitrogen of the N→O group can be attached or wherein the nitrogen of the N→O group is part of these groups.

The N→O group can be represented by the following general structures:

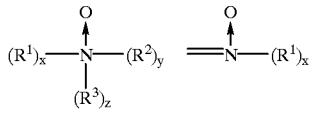

wherein $R^1$, $R^2$, and $R^3$ are aliphatic groups, aromatic, heterocyclic or alicyclic groups or combinations thereof, x or/and y or/and z is 0 or 1 and wherein the nitrogen of the N→O group can be attached or wherein the nitrogen of the N→O group forms part of these groups.

The N→O group can be part of the polymerisable unit (P) or can be attached to the polymeric backbone or a combination of both.

Suitable polyamine N-oxides wherein the N→O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N→O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N→O group is attached to the R-group.

Other suitable polyamine N-oxides are the polyamine oxides whereto the N→O group is attached to the polymerisable unit.

Preferred class of these polyamine N-oxides are the polyamine N-oxides having the general formula (A) wherein R is an aromatic, heterocyclic or alicyclic groups wherein the nitrogen of the N→O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (A) wherein R are aromatic, heterocyclic or alicyclic groups wherein the nitrogen of the N→O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers useful herein typically have a ratio of amine to the amine N-oxide of about 10:1 to about 1:1000000. However the amount of amine oxide groups present in the polyamine N-oxide containing polymer can be varied by appropriate copolymerization or by appropriate degree of N-oxidation. Preferably, the ratio of amine to amine N-oxide is from about 2:3 to about 1:1000000. More preferably from about 1:4 to about 1:1000000, most preferably from about 1:7 to about 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine N-oxide containing polymer can be obtained in almost any degree of polymerisation. The degree of polymerisation is not critical provided the material has the desired water-solubility and dye-suspending power.

Typically, the average molecular weight of the polyamine N-oxide containing polymer is within the range of about 500 to about 1000,000; preferably from about 1,000 to about 50,000, more preferably from about 2,000 to about 30,000, most preferably from about 3,000 to about 20,000.

Such polymers having a net cationic charge include polyvinylpyrrolidone (PVP) as well as copolymers of N-vinylimidazole N-vinyl pyrrolidone, having an average molecular weight range in the range about 5,000 to about 100,000,preferably about 5,000 to about 50,000; said copolymers having a molar ratio of N-vinylimidazole to N-vinylpyrrolidone from about 1 to about 0.2, preferably from about 0.8 to about 0.3.

Other Optional Ingredients Include:

Additional Softening Agents: which are nonionic fabric softener materials. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g.>40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weigt ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Surfactant/Concentration Aids

Although as stated before, relatively concentrated compositions of the unsaturated material of Formula (I) and (II) above can be prepared that are stable without the addition of concentration aids, the concentrated compositions of the present invention may require organic and/or inorganic concentration aids to go to even higher concentrations and/or to meet higher stability standards depending on the other ingredients.

Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

Such mono-long-chain-alkyl cationic surfactants useful in the present invention are, preferably, quaternary ammonium salts of the general formula:

$$[R^2N^+R^3]\,X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coca) choline ester and/or $C_{16}$–$C_{18}$ tallow choline ester at from about 0.1% to about 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

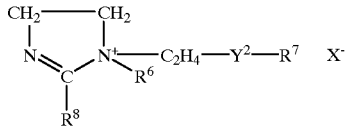

wherein $y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

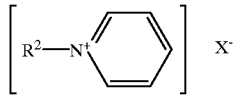

wherein $R^2$ and X— are as defined above. A typical material of this type is cetyl pyridinium chloride.

Nonionic Surfactant (Alkoxylated Materials)

Suitable nonionic surfactants for use herein include addition products of ethylene oxide and, optionally, propylene oxide, with fatty alcohols, fatty acids, fatty amines, etc.

Suitable compounds are substantially water-soluble surfactants of the general formula:

$$R^2—Y—(C_2H_4O)_{z—C2}H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 8 to 20, preferably from 10 to 18 carbon atoms.

Y is typically —O—, —C(O)O—, —C(O)N(R)—, or —C(O)N(R)R—, in which $R^2$ and R, when present, have the meanings given hereinbefore, and/or R can be hydrogen, and z is at least 8, preferably at least 10–11.

The nonionic surfactants herein are characterized by an HLB (hydrophilic-lipophilic balance) of from 7 to 20, preferably from 8 to 15.

Examples of particularly suitable nonionic surfactants include

Straight-Chain, Primary Alcohol Alkoxylates such as tallow alcohol-EO(11), tallow alcohol-EO(18), and tallow alcohol-EO(25);

Straight-Chain, Secondary Alcohol Alkoxylates such as 2-$C_{16}$EO(11); 2-$C_{20}$EO(11); and 2-$C_{16}$EO(14);

Alkyl Phenol Alkoxylates, such as p-tridecylphenol EO(11) and p-pentadecylphenol EO(18), as well as Olefinic Alkoxylates, and Branched Chain Alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moieties selected from the group consisting of alkyl groups and hydroxyalkyl groups with 1 to 3 carbon atoms.

Examples include dimethyloctylamine oxide, diethyldecylamine oxide, bis-(2-hydroxyethyl)dodecylamine oxide, dimethyldodecyl-amine oxide, dipropyltetradecylamine oxide, methylethylhexadecylamine oxide, dimethyl-2-hydroxyoctadecylamine oxide, and coconut fatty alkyl dimethylamine oxide.

Fatty Acids

Suitable fatty acids include those containing from 12 to 25, preferably from 16 to 20 total carbon atoms, with the fatty moiety containing from 10 to 22, preferably from 10 to 14 (mid cut), carbon atoms. The shorter moiety contains from 1 to 4, preferably from 1 to 2 carbon atoms.

Electrolyte Concentration Aids

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtiain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

Another optional ingredient is a liquid carrier. The liquid carrier employed in the instant compositions is preferably at least primarily water due to its low cost relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Still other optional ingredients are stabilizers, such as well known antioxidants and reductive agents, Soil Release Polymers, bacteriocides, colorants, perfumes, preservatives, optical brighteners, anti ionisation agents, antifoam agents, enzymes and the like.

The invention will be further illustrated by means of the following examples.

EXAMPLES

General molecular structures: C-(A)x-(B)y-(A)z-D

A. Effect of a water-soluble non-block copolymer (PVP) on the viscosity of block copolymer-stabilized lamellar droplet dispersions:

Polymer used:

| Polymer | C and D | A | B | x | y | z |
|---|---|---|---|---|---|---|
| P-1 | methyl | ethoxy | PPT | 45 | 5 | 45 |
| P-2 | Poly vinyl pyrrolidone (PVP) | | | | | |

Storage viscosities:

| Content/% of | | 7 day storage viscosity at: | | | | |
|---|---|---|---|---|---|---|
| P-1 | P-2 | 4 | 10 | RT | 35 | 50 |
| 0.33 | — | S | >20000 | 1210 | 570 | 1730 |
| — | 0.33 | S | S | S | 720 | 1230 |
| 0.33 | 0.33 | S | 6800 | 328 | 155 | 320 |
| 0.33 | 1.0 | S | 4500 | 700 | 323 | 530 |
| 0.33* | 1.0* | S | 19300 | 560 | 435 | 1670 |
| 0.66 | 1.0 | S | >20000 | 413 | 225 | 303 |
| 1.0 | 1.0 | S | 15200 | 385 | 200 | 230 |

*Means that both polymers have been added to the water seat. Otherwise the polymers have been added after the perfume when still hot.

The viscosity has been measured using a Brookfield Viscometer. The method used is the standard method known by persons skilled in the art.

B. Effect of hydrophilic and hydrophobic block lengths of EO/PO/EO triblock copolymers on the viscosity of lamellar droplet dispersions:

A is an ethoxy unit (EQ) and B is a relatively hydrophobic unit like propoxy (PO) or propylene terephthalate (PPT).

C and D, as well as x and z, are the same. They are all hydroxyl groups, except for the reference polymer which has methyl end groups.

| | | | | Cps after storage: | |
|---|---|---|---|---|---|
| Polymer | # EO's | # PO's | F** | 3 days at RT[1] | 10 days at RT[2] |
| Reference | 80 | 5** | 1425 | S | 470 |
| Synperonic L35 | 22 | 16 | 608 | S | — |
| Synperonic F38 | 88 | 16 | 1664 | S | — |
| | 6200 | | | | |
| Synperonic F87 | 120 | 39 | 6201 | 115 | — |
| Synperonic F88 | 206 | 39 | 9555 | 180 | — |
| Synperonic F108 | 297 | 56 | 19768 | 180 | — |
| Pluronic PE 10400 | 50 | 56 | 5936 | 50 | 73 |
| Pluronic PE 10500 | 74 | 56 | 7280 | 333 | 83 |

*The numbers 1 and 2 stand for the reduced and the full matrix, respectively. The difference between the two is that in the reduced matrix some of the emulsifiers/dispersants have been omitted.
**PPT units, length equivalent to 15PO units.

C. Effect of the center block chemistry on the viscosity of lamellar droplet dispersions:

C and D are end groups, A is an ethoxy unit and B is a relatively hydrophobic unit like propoxy (PO), propylene terephthalate (PPT), n-butoxy (BuO), hexadecylene (C16), or dodecylene (C12).

C and D, as well as x and z, are the same.

| Center | | | | Viscosity (cps) after 7 days storage: | | | | |
|---|---|---|---|---|---|---|---|---|
| block | C | x | y | 4 | 10 | RT | 35 | 50° C. |
| PPT | methyl | 45 | 5 | 630 | 120 | 35 | 35 | 60 |
| PO | methyl | 55 | 17 | >20000 | 360 | 45 | 45 | 72 |
| PO | methyl | 63 | 13 | >20000 | 290 | 40 | 43 | 68 |
| PO | hydroxyl | 40 | 16 | >20000 | 342 | 35 | 35 | 43 |
| BuO | methyl | 43 | 9 | 1780 | 160 | 35 | 40 | 60 |
| BuO | methyl | 50 | 14 | 7700 | 265 | 36 | 38 | 58 |
| C16 | methyl | 75 | 1 | 1260 | 223 | 38 | 40 | 45 |
| C12 | methyl | 60 | 1 | 1146 | 238 | 52 | 50 | 54 |

D. Effect of end-groups on the viscosity of lamellar droplet dispersions:

C and D are end groups, A is an ethoxy unit and B is a relatively hydrophobic unit like propoxy (PO) or propylene terephthalate (PPT).

C and D, as well as x and z, are the same.

| End group functionallity | B | x | y | Viscosity (cps) after 7 days storage: 10 | RT | 35 | 50° C. |
|---|---|---|---|---|---|---|---|
| Methyl | PPT | 40 | 5 | >20000 | 128 | 40 | 85 |
| Hydroxyl | PO | 40 | 15 | S | >20000 | 43 | 80 |
| Methyl | PO | 55 | 17 | 360 | 45 | 45 | 72 |
| Methyl | PO | 63 | 13 | 290 | 40 | 43 | 68 |
| Hydroxyl | PO | 40 | 16 | 342 | 35 | 35 | 43 |
| Acetate | PO | 40 | 15 | S | 7800 | 98 | 193 |
| Trimethyl-amido chloride | PO | 40 | 16 | 328 | 43 | 40 | 43 |
| Hydroxyl | PO | 14 | 30 | S | S | 4600 | 14400 |
| Methyl | PO | 14 | 30 | S | S | 5600 | 9400 |

S = solid, RT = room temperature/° C.

E. Effect of a block copolymer according to the invention on the viscosity stability as measured after 7 days storage. Two experiments have been performed in different softener matrices.

| | 4° C. | 10° C. | RT | 35° C. | 50 ° C. |
|---|---|---|---|---|---|
| 1. w/o polymer P-1* | S | S | S | S | S |
| with 0.5% P-1 | S | S | 88 | 160 | 235 |
| 2. w/o polymer P-1 | 360 | 123 | 78 | 113 | 235 |
| with 0.5% P-1 | 40 | 40 | 40 | 68 | 153 |

*for P-1 description see Table A.

A typical formulation in above-mentioned examples for use as a rinse conditioner to which the different polymers were added, according to the invention comprises

| | weight % |
|---|---|
| Softener active | 24.5 |
| PGMS | 2.0 |
| TEA 25 | 1.5 |
| HCl | 0.12 |
| Antifoam agent | 0.019 |
| Blue dye | 80 ppm |
| CaCl2 | 0.35 |
| Perfume | 0.90 |

In conclusion above results clearly show:

a. Beyond a certain length of the ethoxy side blocks the triblock copolymers provide a reduction of the product viscosity.

b. The more hydrophobic the center block becomes the better the polymer stabilizes the viscosity.

c. The combination of PVP with a triblock copolymer such as H3C-(EO)45-(PT)5-(EO)45-CH3 provides the best viscosity stabilizing benefits. This MAY be due to PVP providing a shield around the positive charges such that the center block of the polymer adheres even better to the droplets.

What is claimed is:

1. A liquid fabric softening composition comprising a) from 0.1–10% of block copolymer with a hydrophobic backbone and one or more hydrophilic side chains, said block polymer being selected from the groups consisting of polymers having the formula:

1. C-(A)x-(B)y-D wherein A are water-soluble monomers and B are insoluble or partially water-soluble monomers, C and D are end-groups or a hydrogen atom; x and y are intepers from 1–200,
2. C-(A)x-(B)y-(A)z-D wherein A are water-soluble monomers and B are insoluble or partially water-soluble monomers; C and D are end-groups or a hydrogen atom; x, y and z are integers from 1–200,
3. D-(A)x-R-(A)z-C wherein R is an insoluble or partially water-soluble monomer or a fatty alcohol or acid of which one carbon is substituted with polymer blocks, A are water-soluble monomers, C and D are end groups or a hydrogen atom, x and y are integers of from 1–200; and b) from 0.1 to 10% of a non-ionic water-soluble polymer selected from the group consisting of polyvinylpyrrolidone, polyvinylpyridine-N-oxide, polyethylene glycol and substituted polyglycols; and c) from 1% to 80% of fabric softener active.

2. A fabric softening composition according to claim 1 wherein components a and b are in a ratio of a/b which ranges from 0.01 to 100.

3. A fabric softening composition according to claim 1 wherein the integers x and z range from 30–60 and y ranges from 3–50.

4. A fabric softening composition according to claim 3 wherein the integers x and z range from 30–60 and y ranges from 40–50.

5. The composition of claim 4 wherein component c) is a quaternary ammonium fabric softener.

6. The composition of claim 5 wherein the amount of component c) is from 5% to 50%.

7. The composition of claim 6 wherein the amount of component a) is from 0.2 to 6% and the amount of component b) is from 0.2 to 6%.

8. The composition of claim 7 wherein the amount of component c) is from 15% to 35%.

* * * * *